US010345086B1

(12) United States Patent
Ginetto et al.

(10) Patent No.: US 10,345,086 B1
(45) Date of Patent: Jul. 9, 2019

(54) MOUT PROJECTILE WITH SABOT INTEGRATED SHOT START

(71) Applicant: The United States of America as Represented by the Secretary of the Army, Washington, DC (US)

(72) Inventors: Stephen Ginetto, Carlstadt, NJ (US); Andrew Moramarco, Staten Island, NY (US); Leanne Mohla, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/845,008

(22) Filed: Dec. 18, 2017

(51) Int. Cl.
*F42B 14/06* (2006.01)
*F41A 21/46* (2006.01)

(52) U.S. Cl.
CPC ..... *F42B 14/067* (2013.01); *F41A 21/46* (2013.01)

(58) Field of Classification Search
CPC ..... F42B 14/02; F42B 14/064; F42B 14/061; F42B 10/14; F41A 1/04
USPC ..... 102/440, 520, 521, 522; 89/7
See application file for complete search history.

(56) References Cited

U.S. PATENT DOCUMENTS 2,638,051 A * 5/1953 Critchfield ..... F42B 14/064 102/522
2,992,612 A * 7/1961 Critchfield ..... F42B 14/064 102/522
3,218,929 A * 11/1965 La Costa ..... F41F 5/00 102/342
3,225,654 A * 12/1965 Barr ..... F42B 12/58 102/351
3,613,596 A * 10/1971 Walde ..... A61K 31/00 102/525
4,140,061 A * 2/1979 Campoli ..... F42B 14/061 102/521
4,208,948 A * 6/1980 Cobb ..... F41A 1/08 89/1.706
4,385,561 A * 5/1983 Madderra ..... F42B 14/06 102/523
4,802,415 A * 2/1989 Clarke ..... F42B 5/045 102/434
4,852,458 A * 8/1989 Bulman ..... F41A 1/04 89/7
4,852,459 A * 8/1989 Bulman ..... F41A 1/04 89/7
4,930,423 A * 6/1990 Bulman ..... F41A 1/04 102/434
4,934,242 A * 6/1990 Bulman ..... F41A 1/04 102/440
4,939,997 A * 7/1990 Hoffman ..... F42B 5/03 102/503
4,993,309 A * 2/1991 Bulman ..... F41A 1/04 102/440

(Continued)

*Primary Examiner* — Michael D David
(74) *Attorney, Agent, or Firm* — Michael C. Sachs

(57) ABSTRACT

A light weight shoulder fired projectile weapon is shown which could be used against multiple target sets. The accurate and consistent muzzle velocity needed for these multiple purposes is accomplished through accurate and consistent gun chamber pressure. A shot start feature integrated with sabot sections on the projectile consistently holds the projectile in place in its launch tube until the consistent chamber pressure is reached.

9 Claims, 5 Drawing Sheets

(56) References Cited

U.S. PATENT DOCUMENTS

| | | | | | |
|---|---|---|---|---|---|
| 5,804,759 | A * | 9/1998 | Sauvestre | F42B 7/10 | 102/439 |
| 6,575,097 | B1 * | 6/2003 | Nodarse | F42B 5/045 | 102/434 |
| 6,626,113 | B1 * | 9/2003 | Gilman | F42B 8/02 | 102/439 |
| 6,776,102 | B2 * | 8/2004 | Thiesen | F42B 14/02 | 102/524 |
| 7,013,811 | B1 * | 3/2006 | Sebasto | F42B 14/061 | 102/520 |
| 7,036,434 | B1 * | 5/2006 | Vo | F42B 12/06 | 102/503 |
| 7,270,060 | B1 * | 9/2007 | Manole | F42B 12/06 | 102/520 |
| 9,157,716 | B1 * | 10/2015 | Ginetto | F42B 14/067 | |
| 9,410,779 | B1 * | 8/2016 | Ginetto | F42B 10/14 | |
| 9,470,491 | B1 * | 10/2016 | Ginetto | F42B 10/14 | |
| 9,689,649 | B1 * | 6/2017 | Hooke | F42B 14/02 | |
| 9,702,673 | B1 * | 7/2017 | Ginetto | F42B 10/14 | |
| 2004/0244573 | A1 * | 12/2004 | Tilling | F42B 14/02 | 89/33.01 |
| 2006/0124020 | A1 * | 6/2006 | Bishop | F41A 1/02 | 102/438 |
| 2007/0006767 | A1 * | 1/2007 | Brislin | F42B 7/04 | 102/489 |
| 2014/0076191 | A1 * | 3/2014 | Abeln | F42B 14/02 | 102/526 |

* cited by examiner

MOUT PROJECTILE WITH SABOT INTEGRATED SHOT START

U.S. GOVERNMENT INTEREST

The inventions described herein may be made, used, or licensed by or for the U.S. Government for U.S. Government purposes.

BACKGROUND OF INVENTION

In the field of gun launched munitions, a need exists to provide accurate and consistent muzzle velocity of the munition, such as a gun launched projectile. This is done by providing a 'shot start' which may be a tab connected to the munition, and where the shot start tab juts out from the munition's exterior and is lodged in a mating cavity within the side of the launch tube. In order to launch the munition, there must be sufficient launch pressure on the munition to physically break the shot start. It can be seen that providing a shot start would be a means to provide a consistent launch velocity of these munitions as designed in such launch tubes. The munitions may embrace many types, such as shoulder fired weapons, multi target weapons, MOUT or other types. The munition may also be surrounded inside the gun tube by a sabot, or sabot comprised of multiple sections. It would be a further advantage to such munition launching systems if the shot start means and the sabot means were designed to be of one unitary piece. There would be advantages for weight, economics of manufacturing, construction and consistency of the structure.

BRIEF SUMMARY OF INVENTION

An integrated sabot shot start projectile has been produced in accordance with this invention. The projectile sabots with an integrated shot start were parts developed on a MOUT (Military Operations in Urban Terrain) ATO SFW (Advanced Technology Objective Shoulder Fired Weapon) IAM requirement program. This program was to develop a shoulder fired weapon that would be lighter than current shoulder fired weapons but which could be used against multiple target sets. It is known that the chamber pressure of a gun directly affects the velocity of its projectile. So, in this gun launched system it was crucial to find a method to obtain an accurate and consistent gun chamber pressure to maintain an accurate and consistent muzzle velocity. Methods for obtaining the above mentioned consistent chamber pressure included providing a shot start tab. To meet the requirements of low weight and high velocity this system also utilized sabot technology. The system was accomplished by integrating the shot start tab onto the sabot of the projectile, as a unitary component of tab with sabot. The shot start was integrated on to the sabot for reasons including ease of assembly, positive visibility since it was seated in the gun groove, no interference with gun exit sabot discard, to help better seal the gun gases, and for lowering overall manufacturing costs. The sabot with an integrated shot start was developed to fit in sections around the body of the projectile and in this case the sabot had three 120 degree sections. A shear tab on the sabot would not only hold the projectile in place until broken at a predetermined pressure, but would also be used to correctly locate and lock the projectile into place. The tab on the sabot would line up with a corresponding tab or groove location in the gun tube. The sabot could have either a tab or a groove depending on the mating component of the gun tube. There are various ways of loading this type of munition (including shot start and sabot) into the launch tube. Methods include a split breach. Another method would include inserting the projectile through the aft end of the gun tube and rotating it into place when it reached the corresponding tab or groove location in the gun tube. At this point, the projectile could no longer move through the gun tube unless the shear tab on the sabot were broken. After the desired chamber pressure would be reached, the shear tab would fail at the shear groove and the projectile would be free to move down the gun tube. (This pressure is pre-determined based on the depth of the shear groove dimension in the tab and can be adjusted depending on firing requirements). The projectile then moves and follows typical interior ballistic patterns. The shot start portion of the sabot may be left over partially disposed of in the groove of the gun tube. Upon exit from the gun tube, the sabots discard without impedance from the body of the projectile. This invention served two purposes, (1) to load and hold the projectile in place inside the gun tube up to a certain pre-determined pressure and (2) to add sabots to the projectile to allow for maximum acceleration and muzzle velocity of the projectile until it is out of the gun tube. Although sabots have been used on other projectiles, this is the first attempt to integrate the sabots with a shot start feature. A radial shear groove on the tab allows the ring to fail at a determined pressure. During testing, the sabot sections with the integrated shot start ring worked as designed, and held the projectile in place until the desired chamber pressure was reached. After the chamber pressure was reached, the projectile traveled out the muzzle of the gun tube achieving the desired velocity. The sabot sections discarded off the body of the projectile during the first 5-10 meters after exit, without impeding the flight trajectory. The sabots were successful in all tested shots.

OBJECTS OF THE INVENTION

Accordingly, it is an object of the present invention to develop a shoulder fired weapon that would be lighter than current shoulder fired weapons but which could be used against multiple target sets.

Another object of the present invention is to develop a shoulder fired weapon with an accurate and consistent gun chamber pressure to maintain an accurate and consistent muzzle velocity.

It is a further object of the present invention to develop a shoulder fired weapon that will hold its projectile in place until a desired chamber pressure is reached.

It is a yet further object of the present invention to develop a shoulder fired weapon with sabot sections and to integrate the sabots with a shot start feature.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

Figure 6:
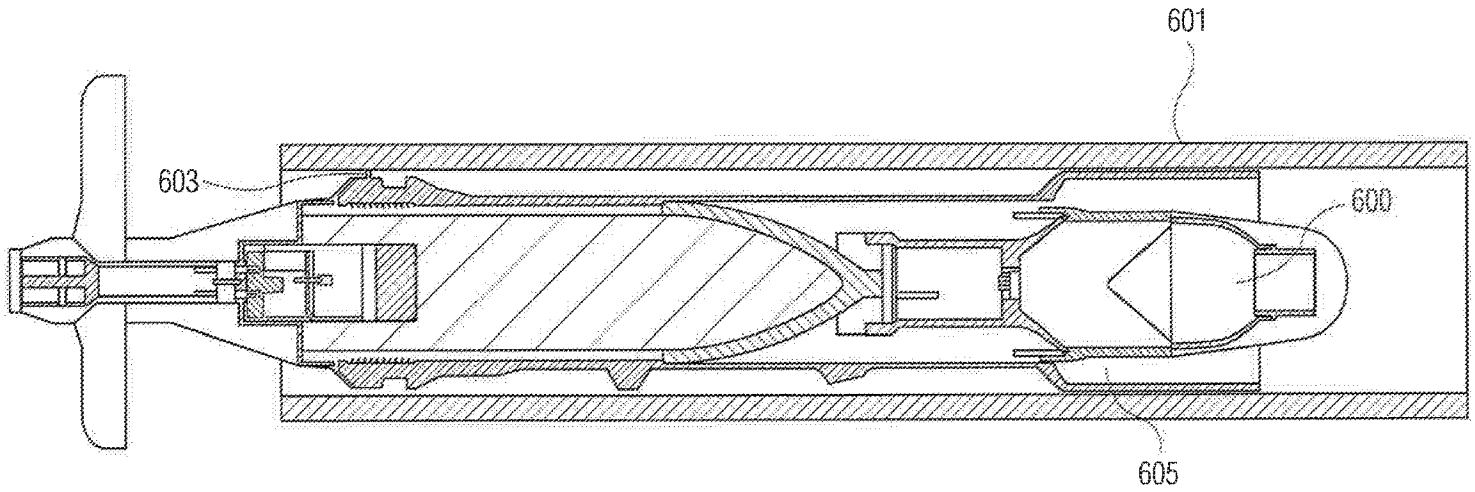

FIG. 6 shows the round 600, enclosed by three symmetrical sectioned sabot parts which join to form sabot 605, all placed inside a launching tube 601.

DETAILED DESCRIPTION

Figure 1:
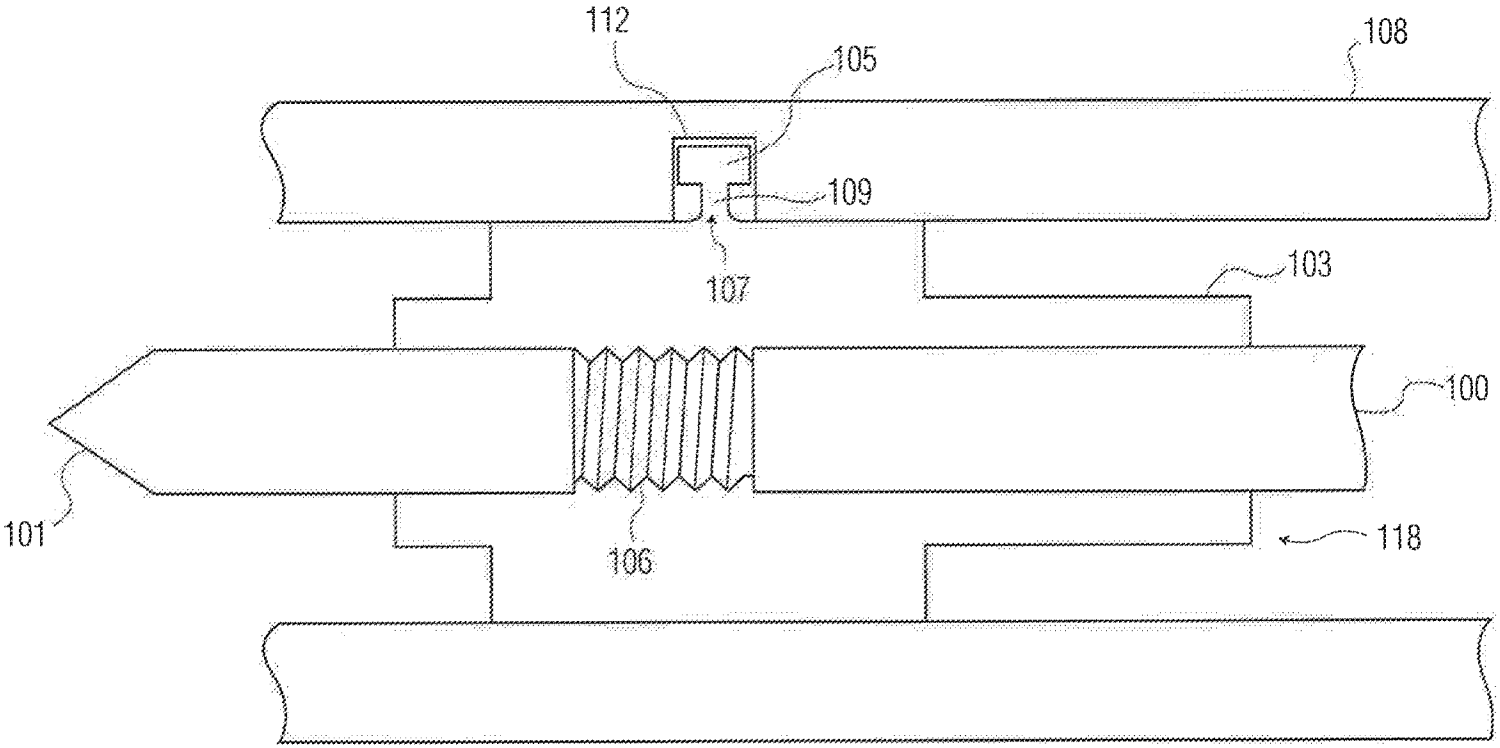
FIG. 1 shows a conceptual weapon system having a gun tube containing a MOUT type projectile with a sabot, the sabot having an integral shot start tab jutting out from the sabot, and with gun tube having a mating recessed area to receive the tab, according to this invention.
Figure 2:
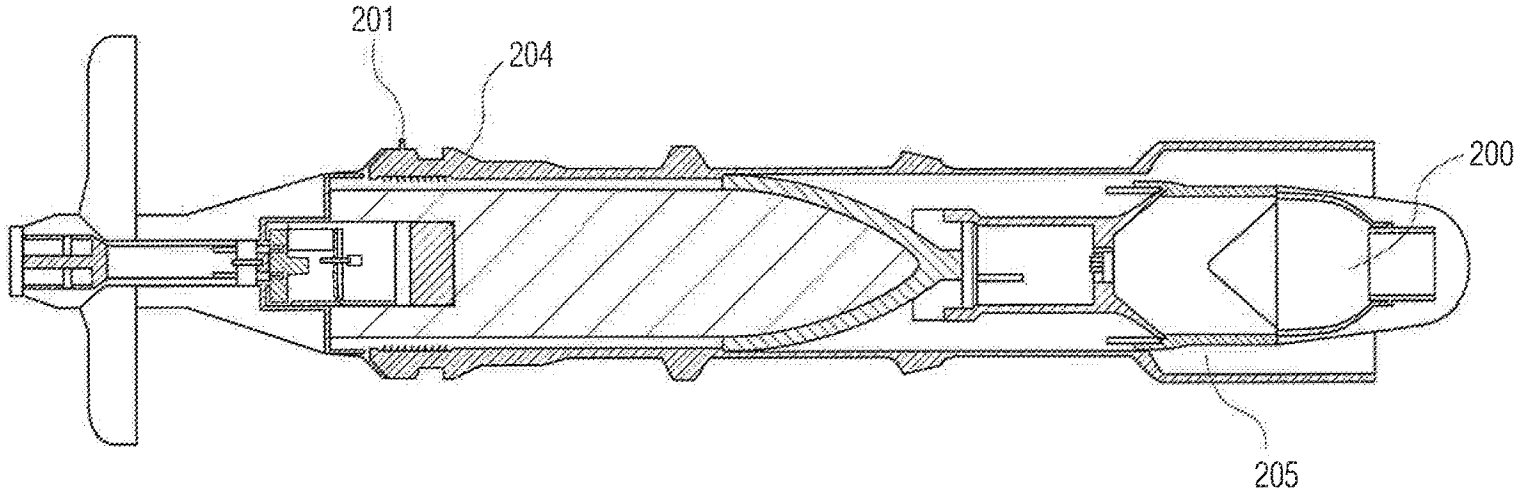
FIG. 2 shows a MOUT round 200 which may be launched from a shoulder borne launch tube which has a shot start tab 201 included when the round is insetted/loaded into the tube, according to this invention.
Figure 3:
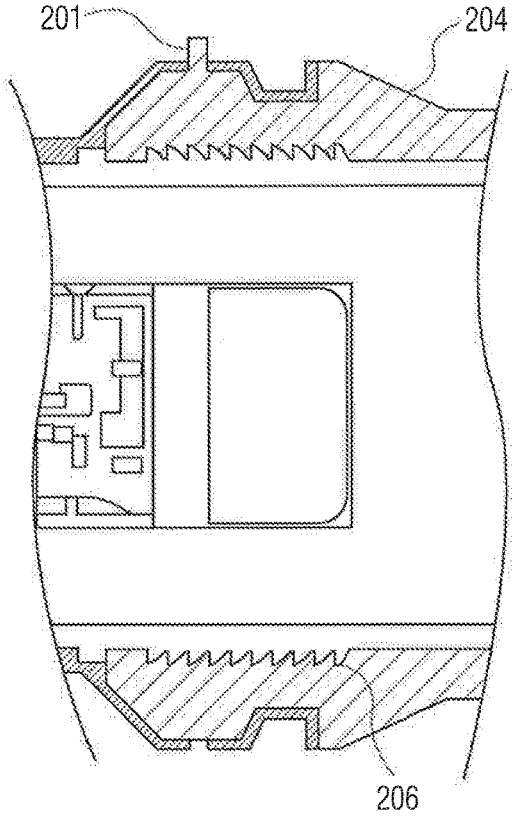
FIG. 3 shows an enlarged view of shot start tab 201 according to this invention.
Figure 4:
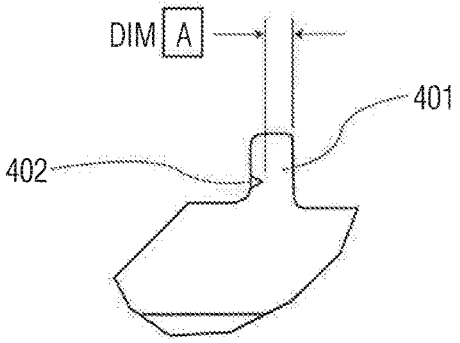
FIG. 4 shows another embodiment of a shot start tab 401 including a built in weak spot 402, which helps the shot start tab to break off at the time of launching of the round, according to this invention.
Figure 5:
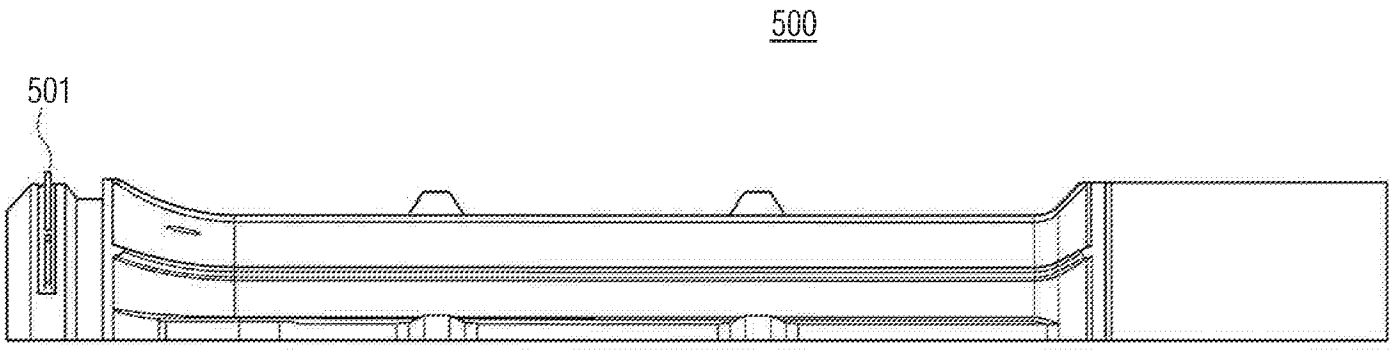
FIG. 5 shows an outside view of a one third section 500 of the sabot.

In FIG. 1, there is shown a conceptual weapon system having a gun tube 108 containing a MOUT type projectile 100. The projectile has a nose 101 and an aft section. The projectile is functionally connected to a discarding sabot 103 in a grooved region 106. The projectile is completely surrounded axially by the sabot in the location where the projectile is fitted into the tube, so that the sabot would ordinarily block gas pressures such as 118 from escaping around the projectile round through the tube. The projectile and sabots are subjected to launch forces and/or gas pressures 118 to initiate a launch of said projectile. The projectile's sabot has an integral shot start tab 107 jutting out from the sabot, and the gun tube has a mating recessed area 112 to snugly receive the shot start tab when the projectile with sabot are loaded into the gun tube. In this conceptual arrangement, the unitary sabot/shot start has a tab with a distal section 105 connected to the sabot through a cross-sectionally narrower section 109 of said tab. The narrower section functions as a kind of shear groove which allows the tab to shear off during initiation of a launch at a predetermined launch force or gas pressure acting on the projectile with sabot. The predetermined forces/pressure would be sufficiently robust to effect a successful launch of said projectile. The tab first inserted into the gun tube prevents a launch of the projectile before such predetermined necessary forces/gas pressure is exceeded. FIG. 2 shows a MOUT round 200, which may be launched from a shoulder borne launch tube which may/may not be enclosed at its rear (tube not shown here). Regions such as 204 and 205 on the round may be on the plastic sabot sections to help mount the round within its tube and to contain gas pressures surrounding the round, within a launching tube. Region 206 having buttress grooves would correspond to region 106 shown in FIG. 1, for joining the round to its enclosing sabot. A shot start 201 (shown in more detail in FIG. 3), is lodged into the side wall of the tube, when the round is inserted/loaded into the tube. Shot starts may be formed on the sabot sections in multiple possible shapes/sizes, cross sectional shapes, so long as there are mating areas on the inside of the launching tube to receive them, and where the shot start is weak enough to break when the sufficient select launch force is applied to the round. Additionally, there are multiple ways to create weakened locations on the shot start(s) to enable them to shear at the desired launch force/chamber pressure conditions. For example, the shot starts may be circumferential rings around all/upon select locations around the sabot sections, or just one tab, at one spot on the sabot, (or multiple tabs), or rod(s), for example. FIG. 4 shows another embodiment of a shot start 401, but here including a built in circumferential weak spot 402, which helps the shot start 401 to break off at the time that sufficient launch forces/gas pressure has built in the tube, to launch the round. FIG. 5 shows an outside view of a one third section 500 of the sabot. The sabot is comprised of three symmetrical such sabot sections, which enclose the round 200, and holding it within the launch tube. Area 501 on the sabot section would represent the shot start feature; these areas have mating indented areas on the inside surface of their launching tube. FIG. 6 shows the round 600, enclosed by three symmetrical sectioned sabot parts which join to form sabot 605, all placed inside a launching tube 601, which may be a shoulder borne launch tube, and which may/may not be enclosed at its rear. A shot start is represented by caption 603 there.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A weapon system having a gun tube (108), a projectile (100) which is functionally connected to a discarding, single item sabot integrated with a unitary shot start (103) in a grooved region (106), and wherein said unitary shot start with sabot with projectile are subjected to gas pressure (118) to initiate a launch of said projectile, and wherein said unitary shot start with sabot has a unitary shot start tab (107) feature jutting out from said unitary shot start with sabot, and wherein said gun tube has a mating recessed area (112) to snugly receive said shot start tab when said projectile with unitary shot start with sabot are loaded into said gun tube, and wherein said shot start tab (107) has a distal section (105) connected to said unitary shot start with sabot through a cross-sectionally narrower section (109) of said tab, and wherein said narrower section thereby functions as a shear groove which allows the tab to shear off during initiation of a launch at a predetermined gas pressure acting on said unitary shot start with sabot and projectile, which predetermined pressure is sufficiently robust to effect a successful launch of said projectile, and wherein said tab inserted into said gun tube prevents a launch of said projectile before such predetermined gas pressure is exceeded.

2. The weapon system as in claim 1 wherein the sabot is comprised of a plurality of symmetrical circumferential sections.

3. The weapon system as in claim 1 wherein the shot start uses a shot start ring.

4. The weapon system as in claim 1 wherein said recessed area (112) is in an inner tube area of said gun tube (108).

5. The weapon system as in claim 1 wherein the shot start uses crimping.

6. The weapon system as in claim 1 wherein the shot start uses a shot start rod.

7. The weapon system as in claim 1 wherein the unitary shot start tab sabot has a unitary circumferential ring arrangement and there is provided a mating channel for the ring within the inside of the tube.

8. The weapon system as in claim 7 wherein a circumferential shear groove is added to the ring.

9. The weapon system as in claim 8 wherein the projectile is a MOUT 75 mm round.

* * * * *